United States Patent [19]

Carothers et al.

[11] Patent Number: 4,480,245

[45] Date of Patent: Oct. 30, 1984

[54] ELECTRIC CUTOUT

[75] Inventors: Charles H. Carothers, Bloomington; John E. Garau, Martinsville; Thomas P. Basa, Bloomington, all of Ind.

[73] Assignee: Westinghouse Electric Corp., Pittsburgh, Pa.

[21] Appl. No.: 461,794

[22] Filed: Jan. 28, 1983

[51] Int. Cl.[3] ..... H01H 71/08

[52] U.S. Cl. ..... 337/180; 337/168

[58] Field of Search ..... 337/168, 180, 181, 171, 337/172, 173

[56] References Cited

U.S. PATENT DOCUMENTS 2,734,964 2/1956 Edwars et al. ..... 337/180

*Primary Examiner*—Harold Broome

*Attorney, Agent, or Firm*—G. H. Telfer

[57] ABSTRACT

An electrical cutout having a support insulator with a line terminal and fuse support assembly at each end, each of which includes a line terminal, a fuse support element and means for their support on the insulator and also includes a contact element more highly conductive than the other elements of the assembly that extends from line terminal to the fuse support element for a continuous highly conductive path therebetween free of mechanical joints.

5 Claims, 3 Drawing Figures

ELECTRIC CUTOUT

BACKGROUND AND SUMMARY OF THE INVENTION

This invention relates generally to electrical protective equipment and, more particularly, to fused cutouts.

Fused cutouts are devices used extensively in electrical distribution circuits, such as for line sectionalizing. They are used for opening a relatively high current circuit, usually 100 amperes or more, upon an overload with means for facilitating replacement of the fuse and reclosing on a distribution line in the field. A cutout mechanically and electrically supports a fuse device in relation to a distribution line.

For background refer to FIGS. 1 and 2 which illustrate a widely used type of fused cutout. The cutout has an elongated, solid porcelain insulator 10. The insulator 10 has top and bottom rods 11 and 12 extending from it laterally as well as a back bracket 14, the latter being to secure the device on a pole or other fixed support. Each of the rods 11 and 12 supports an assembly for removably holding and making electrical contact with the ends of a fuse holder 16 containing a fuse link. The fuse holder 16 will not be described herein other than that it is characteristic of the fuse devices used with cutouts that the upper and lower contacts 18 and 20 are in pressure conductive engagement with fuse support elements affixed to the insulator.

In FIGS. 1 and 2, the support elements include a first top bracket 22 and a top hood 24 affixed to the top rod 11. A second top bracket 26 extends upwardly from the top hood 24 and is joined to it by two rivets 60. A guide post 28 extends vertically through the structure including the top hood and the extremity of the first top bracket 22. There are also contact elements 30 having an upper extremity **30*a* that is attached by rivets 60 just under the top bracket 26 and top hood 24 and a lower portion 30*b* supported on the first bracket between which a spring is provided that biases the portions 30*a* and 30*b* of the contact element 30 apart for the purpose of maintaining downward pressure on the bottom portion 30*b* of the contact element within a notch 30*c* of which are engaged the upper contact pegs 18 of the fuse holder 16. FIG. 2 shows the general orientation of the contact elements 30 attached by rivets 60 to bracket 26**.

The second top bracket 26 holds the line terminal 34 for connecting one end of the cutout to a distribution line and that bracket is of highly conductive material such as copper and also must be sufficiently strong to support the terminal such as having a thickness of about 0.125 inch. The conductive path proceeds from the line terminal 34 through the bracket 26 to a riveted joint. Bracket 26 conductively engages the top portion **30*a* of the contact element 30 at the rivet 60 with the head of the staked rivet holding the elements 26 and 30*a* together. The top and bottom portions 30*a* and 30*b* of the contact element 30 are joined by rivets 33 and 30*b* is guided by post 28 as 30*b* is raised by the contact pegs 18 to permit 18 to reach 30*c***.

At the bottom of the structure, the rod 12 supports a bottom hood 36 and also a bottom support casting 42 to which the bottom line terminal 40 is attached by bolt 51. The bottom line terminal bracket 40, like the top line terminal bracket 26, is both highly conductive and mechanically strong. The bottom support casting 42 has fastened to it a contact element 44 which is highly conductive flexible copper strip for contacting the fuse holder contacts 20 at the lower end of the fuse holder 16. Contact element 44 is one of a pair of such contact elements configured similarly to contact elements 30 at the upper end.

A further description of cutouts of the character of that depicted in FIGS. 1 and 2 is contained in Descriptive Bulletin 38-651 of Westinghouse Electric Corp., July 1977, which is herein incorporated by reference.

The cutout as shown in FIG. 1 has been successful in performance. It is however desirable to increase the reliability of the device so that it can serve a longer life and also to reduce its costs. We do so by changing to a design, to be described in greater detail hereinafter, that avoids the need for some of the elements at both the top and bottom ends of the device that require both high conductivity and high mechanical strength. Only a single conductive element at each end is required and it does not need mechanical support capability. It is seen from FIG. 1 that at each of the ends of the device the conductive elements have to be mechanically joined in two places. At the upper end, the line terminal bracket 26 and the top contact portion **30*a* are joined at the rivet 60. Also, the contact support portions 30*a* and 30*b* are joined by a rivet or the like 33. At the lower end, one joint is between elements 44 and 42 where 44 is riveted to 42 and another is between 42 and 40**. These joints are vulnerable to becoming loose or being loose from improper assembly and are completely eliminated as a source of potential problems in the design in accordance with this invention.

In the new design a single conductive element extends from the line terminal to the fuse contacts at each end of the device. We have found that the purposes of the invention can be very satisfactorily achieved by avoiding reliance on the conductive element for any mechanical support and reconfiguring the design so as to permit a continuous conductive element, such as of copper while the other elements may be of steel or the like, to extend from the line terminals to the fuse contacts.

DESCRIPTION OF THE PREFERRED EMBODIMENT

Figure 3:
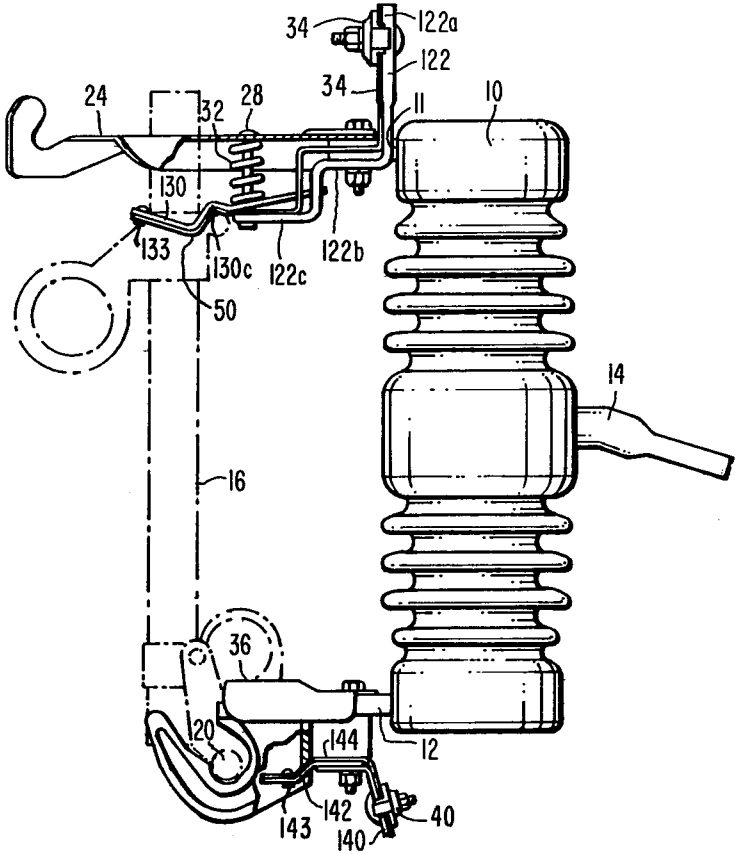
Figure 1:
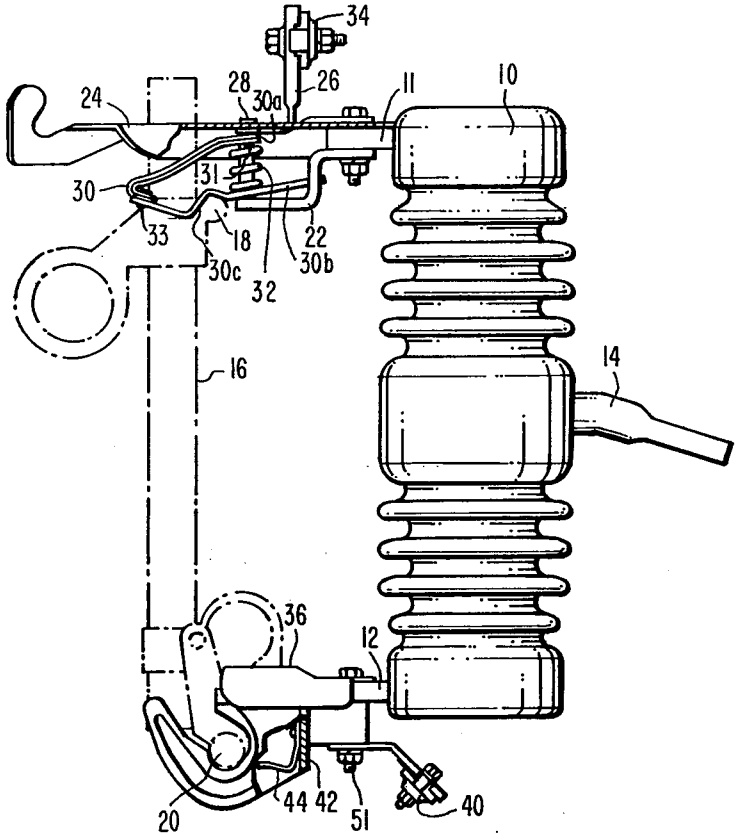
FIG. 1 PRIOR ART
FIG. 1 is an elevation view of a cutout in accordance with the prior art as described above.
Figure 2:
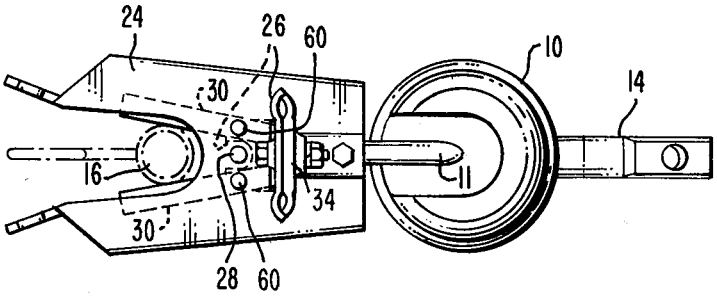
FIG. 2 PRIOR ART
FIG. 2 is a partial plan view of the apparatus of FIG. 1 showing the orientation of certain elements; and, FIG. 3 is an elevation view of a cutout in accordance with an embodiment of the present invention.

Referring to FIG. 3, the general configuration of the device is similar to that of FIGS. 1 and 2. This is highly desirable in order to permit the newly designed cutout to be receptive of the various kinds of fuse holders 16 that are presently used with existing cutouts.

Again a porcelain insulator 10 has extending from it a rod 11 at the top and a rod 12 at the bottom and a bracket 14 from the back for support. A top bracket 122 and a top hood 24 are fastened together onto the top rod 11. The top bracket 122 has an upwardly extending portion **122*a* bearing the upper line terminal 34. That portion of the bracket 122 can be configured with an aperture that permits the bracket to be placed on the top rod 11 while the next portion 122*b* that is perpendicular thereto permits the secure fastening to the rod. The lowest portion of the bracket 122*c* is held by a guide post 28 with the top hood 24. A contact support element 130 extends over the guide post 28 and outwardly from the bracket and is held by spring biasing of the spring 32** in the downward direction against the bracket while being guided and aligned by the post.

A strip 50 of highly conductive material, such as 0.040 inch thick copper, extends from the line terminal 34 to the location and beyond of the fuse contacts at notch 130*c* of the contact support. This strip of material may be bent to the shape illustrated with an aperture to permit clearance at the top and along each side of rod 11. It is securely held in place and physically supported by 122*a* at the line terminal 34 where it makes direct contact to a connected line and by rivets 133 at the extremity of the contact support 130 which also physically supports 50. The strip 50 is unsupported in the area above 122*b* to allow it to move up or down freely while a fuse holder 16 is being installed or removed.

A similar design philosophy is carried out at the lower assembly as well. The structural element line terminal support 140 is utilized only for its mechanical support properties and are not primarily relied on for electrical conduction. The contact support 142 is utilized for mechanical support and also is made of a material that has spring characteristics to assure good contact to the pegs 20 on fuse holder 16. They may therefore be made more economically and the electrical function is more reliably taken over by a strip of conductive contact material 144 that extends from the lower line terminal 40 to the location of the fuse contacts 20. The strip 144, similar to that (50) used in the upper assembly, is riveted to its support at 143 and the support extending outwardly as it does provides a degree of resilience for backing up the contact element and insuring longer life with reliable engagement to a fuse contained in the device. It is to be noted that rivets 133 and 143 are only used to hold the contacts 130 and 144 to their support members and are not in the current path.

We are therefore greatly simplifying the construction of the device for both reliability and economy and have found that it achieves both functions well.

We claim:

1. An electrical cutout comprising:

a support insulator having at each of two spaced locations a combination line terminal and fuse holder assembly; each of said line terminal and fuse holder assemblies including a line terminal, a fuse support element and means for support thereon on said insulator and also including a contact element, more highly conductive than said other assembly elements, that extends continuously from said line terminal to said fuse support element for a highly conductive path therebetween free of mechanical joints, and said contact element comprises a first portion at said line terminal for direct contact to a line connected thereto.

2. An electrical cutout in accordance with claim 1 wherein: each of said line terminal and fuse support assemblies also includes spring means for maintaining pressure on said contact element against fuse contacts of a fuse held between said two assemblies.

3. An electrical cutout in accordance with claim 1 wherein:

at a first of said two spaced locations said means for support includes a bracket having a first portion at said line terminal and supporting said first portion of said contact element, a second portion affixed to means for joining said bracket to said insulator, a third portion proximate said fuse support element, said first, second and third portions of said bracket being physically integral, and said third portion of said bracket being disposed spaced from a hood joined with said bracket second portion to said insulator, said hood and said bracket third portion having a fastener extending directly therebetween with a contact support element and a spring thereon, said contact element being secured on said contact support element on the side thereof away from said hood, said spring biasing said contact support element and said contact element toward said bracket third portion.

4. An electrical cutout comprising:

a support insulator;

a fuse support and connection means including first and second portions affixed in spaced relation to said insulator;

said first portion of said fuse support and connection means comprising a bracket secured to said insulator;

a first fuse clip contact support held by said bracket and extending away therefrom to a position for receiving one end of a fuse device;

a top hood member extending over said first fuse clip contact support in fixed relation with said bracket; spring means for bearing against said top hood and said contact support with a portion of said bracket serving as a stop against the travel of said contact support away from said top hood; line connection means on said bracket; a contact element that is a unitary piece of electrical conductor extending from said line connection means to said contact support and in fixed engagement therewith so that when connected, a line is in direct contact with said contact element and said contact element provides a continuous electrically conductive path free of mechanical joints between the line and the fuse.

5. An electrical cutout in accordance with claim 4 wherein:

said second portion of said fuse support and connection means comprises a bottom terminal support secured to said insulator; a second fuse clip contact support held by said bottom terminal support and having resilience for receiving another and of a fuse device, bottom line connection means supported on said bottom terminal support; a second contact element that is a unitary piece of electrical conductor extending from said bottom line connection means so that, when connected, a line is in direct contact with said second contact element and said second contact element provides a continuous electrically conductive path free of mechanical joints between the line and the fuse.

* * * * *